United States Patent [19]

Kreger

[11] 4,269,698

[45] May 26, 1981

[54] OIL TREATMENT PROCESSES, AND PRODUCTS OBTAINED THEREBY

[75] Inventor: James G. Kreger, Westland, Mich.

[73] Assignee: Edwards Oil Service, Inc., Detroit, Mich.

[21] Appl. No.: 98,230

[22] Filed: Nov. 28, 1979

[51] Int. Cl.[3] ..... C10M 11/00

[52] U.S. Cl. ..... 208/180; 208/181

[58] Field of Search ..... 208/179, 180, 181

[56] References Cited

U.S. PATENT DOCUMENTS

| | | | |
|---|---|---|---|
| 1,788,911 | 1/1931 | Clark | 208/181 |
| 2,030,480 | 2/1936 | Strezynski | 208/180 |
| 2,271,882 | 2/1942 | Ambler | 208/179 |
| 3,930,988 | 1/1976 | Johnson | 208/179 |
| 4,029,569 | 6/1977 | Ivey | 208/180 |

*Primary Examiner*—T. M. Tufariello

*Attorney, Agent, or Firm*—Irving M. Weiner; Pamela S. Burt; John L. Shortley

[57] ABSTRACT

A process for purifying waste oil comprising the steps of admixing with the waste oil an aqueous solution of an alkali metal silicate, and maintaining the waste-oil-silicate solution mixture at a temperature of from 140 to about 200 degrees Fahrenheit, wherein from about 0.001 to about 0.8 pounds of a silicate selected from the group consisting of $$M_4SiO_4,\ M_{2n}(SiO)_n,\ \text{and}\ M_2SiO_5,$$

wherein n is an integer of from about 1 to about 2, and M is an alkali metal, are mixed with each gallon of said waste oil, wherein said aqueous solution of the alkali metal silicate contains from about 1.0 to about 10.0 percent (by weight of said solution) of said silicate, and wherein from about 1.0 to about 10.0 percent (by volume of said waste oil) of said aqueous solution of said silicate is added to said waste oil.

61 Claims, No Drawings

OIL TREATMENT PROCESSES, AND PRODUCTS OBTAINED THEREBY

FIELD OF THE INVENTION

This invention relates to processes for purifying and/or refining waste oil, and products obtained thereby. In this process, the waste oil is heated to a temperature of from about 140 to about 200 degrees Fahrenheit while it is mixed with an aqueous solution of an alkali metal silicate.

DESCRIPTION OF THE PRIOR ART

The United States is dependent upon oil. Massive supplies of oil are required for this country's security and economic well-being. Thus, substantial sums of money have been spent to explore for and develop oil wells; however, despite these efforts, the demand for oil continues to outstrip the supply.

In recent years there has been a growing concern for preserving the integrity of our environment. This has led to legislation which limits the methods of oil exploration allowed in an attempt to ensure that the environment is not adversely affected. Such legislation has increased the costs of extracting oil from the ground and, in some cases, has decreased the operating efficiencies of existing oil wells.

There is a substantial need for a process which can effectively reprocess used oil. Such a process would tend to minimize the United States' reliance upon oil; and it would lessen the amount of pollution now caused by the disposal of used oil.

Many processes have been developed for reprocessing used oil. However, none of them are totally effective.

Jones U.S. Pat. No. 1,949,746 describes a process for treating fouled oil by treating it with from 2 to 10 percent (by volume) of sulfuric acid, removing the sludge formed in the oil by such treatment, and washing the oil with water and an aqueous solution of an alkaline substance such as sodium carbonate or sodium hydroxide. The addition of water to the oil increases the likelihood that contaminants in the oil will hydrolyze. The use of relatively high levels of sulfuric acid converts a substantial portion of the fouled oil to a useless product, and tends to destroy viscosity index improvers which may be present in the waste oil.

U.S. Pat. No. 2,319,598 describes a process for treating waste oil comprising the steps of treating the oil with a caustic compound at an elevated temperature, cooling the oil, adding concentrated sulfuric acid to the oil, allowing the oil to settle, and drawing off the acid sludge in the bottoms. This process has several distinct disadvantages: it generates large quantities of noxious acid sludge which are difficult to dispose of properly, it gives a yield of only about 50 percent of reclaimed oil, and it requires a substantial amount of extensive heating.

U.S. Pat. No. 2,842,112 describes a process for treating waste oil wherein the oil is mixed with an aqueous solution of an alkaline alkali metal phosphate, and the mixture is thereafter subjected to centrifugation. The requirement for centrifugation increases the expense of this process.

Crysiak U.S. Pat. No. 3,282,827 describes a process for treating used oil with a polyoxyalkylene nonionic surface active agent. The patentees teach that ". . . in recent years more and more additives such as detergents, pour point depressants, oxidation inhibitors and viscosity index improvers have been employed in petroleum lubricating oils. While the additives have greatly improved the performance of the lubricating oils, they have also greatly increased the task of re-refining such oils after use". The patentees concluded that "the purification processes used in the past for the separation of carbon and dirt particles from lubricating oils containing no detergent additives cannot be satisfactorily used to purify today's high detergent oils".

Katsuta et al U.S. Pat. No. 3,304,255 describes a process for treating waste oil by adding to it an aqueous solution of strong alkali. The patentees teach that waste oil contains unburned fuel, metallic particles produced by abrasion of engine parts, sulfates of metallic particles, and sulfuric acid; that these contaminant particles are electrically charged in a specific way, as in the case of a colloidal dispersion, so that they do not cohere; and that the addition of caustic alkali to the waste oil neutralizes acidic substances absorbed on the surfaces of the contaminants and produces metal hydroxides, whereby the electrical charges on the contaminant particles are neutralized and deteriorated and contaminating matter is absorbed to the metallic hydroxide.

Chambers et al U.S. Pat. No. 3,625,881 discloses a method for treating waste oil wherein used oil feedstock is flash vaporized at a temperature below its coking point; the dried feedstock is then mixed with concentrated aqueous alkali metal hydroxide and with additional oil at a temperature of about 200 to 300 degrees centrigrade; and the mixture is fed to a centrifuge where a liquid effluent is separated from carbonaceous material in the original feedstock. The involved distillation process described in this patent is expensive and time-consuming.

Moffitt U.S. Pat. No. 3,790,474 describes a process for purifying used oils of solid and liquid contaminants, comprising the steps of heating the oil to a temperature of from about 130 to about 200 degrees Fahrenheit, adding a solution of an alkali metal hydroxide having a concentration of at least 25 percent to the heated oil, maintaining the mixture at the heated temperature, adding an acid solution having a concentration of at least 10 percent to the oil mixture, agitating the acid-treated oil, maintaining the treated oil in a settling container at a temperature of about 150 to 190 degrees Fahrenheit for at least 10 hours, and drawing off the purified oil accumulated at the top of the settling container. The patentee teaches that one of the functions of the alkali metal hydroxide is to absorb and remove water particles mixed in the oil.

Fainman U.S. Pat. No. 3,835,035 describes a process for purifying used lubricating oil comprising mixing the waste oil with a predominantly hydrocarbon liquid diluent, mixing the diluted oil with a mixture of alcohol and water, and centrifuging the mixture. A similar process is described in Fainman et al U.S. Pat. No. 3,819,508. In this latter patent it is taught that the use of excessive amounts of alkali metal hydroxide may increase the amounts of contaminants in the treated waste oil. The patentees state that, when excessive quantities of the monovalent cation are used, the additional sodium is taken up by the nonionic detergent in the waste oil, thereby increasing the ability of the nonionic detergent to suspend metals and sludge within the oil and increasing the ash content of the treated oil.

Ivey, Jr. U.S. Pat. No. 4,029,569 describes a process for reclaiming spent motor oil comprising the steps of heating the oil at a temperature of about 700 degrees Fahrenheit, separating solids which precipitate from said oil, contacting the oil with from about 3 to about 6 percent of concentrated sulfuric acid, and treating the oil with an organic amine to neutralize the petroleum sulfonic acids resulting from the treatment with sulfuric acid. This patent teaches that prior art processes which utilize relatively large amounts of sulfuric acid tend to destroy the viscosity index improvers used in most modern motor oil formulations.

Fainman U.S. Pat. No. 4,105,542 discloses a process for purifying used oil, which contains sludge, metal-containing compounds, and other undesirable components, by diluting the oil with a hydrocarbon component; mixing the oil with a water-alcohol mixture which contains water-miscible alcohol, water, and water-soluble acid; and heating the resulting mixture. Bases, such as ammonium carbonate, sodium carbonate, potassium carbonate, lithium carbonate, and sodium hydroxide, may be employed in this process. The patentee discloses that "... the carbonate and phosphate anions are particularly effective in reducing the solubility of the polyvalent metal cations which are displaced from the metal soaps in the diluted lubricating oils by the monovalent ammonium and alkali metal ions, and in reducing the efficacy of the non-ionic dispersants remaining in the oil to maintain the micellular configuration necessary to keep the solids in sludge in disperse form in the diluted oil". However, the patentee warns that the use of an excessive amount of alkali metal base is detrimental. He states that "... when excessive quantities of the monovalent cation base are employed, the additional sodium from the sodium carbonate is believed to be taken up by the non-ionic detergents in the used oil. As a result, the purified oil obtained from the process will have a higher metals content than that obtained by using a lesser quantity of the alkali base metal".

SUMMARY OF THE INVENTION

It is an object of the invention to provide an improved process for the purification of waste oil. In accordance with this invention, there is provided a process for purifying waste oil comprising the steps of admixing with the waste oil an aqueous solution of an alkali metal silicate and maintaining the waste oil-silicate solution mixture at a temperature of from about 140 to about 200 degrees Fahrenheit, wherein from about 0.001 to about 0.8 pounds of silicate, selected from the group consisting of $$M_4SiO_4,\ M_{2n}(SiO_3)_n,\ \text{and}\ M_2SiO_5,$$

where n is an integer of from about 1 to 2, and M is an alkali metal, are mixed with each gallon of said waste oil, wherein said aqueous solution of the alkali metal silicate contains from about 1.0 to about 10.0 percent (by weight of said solution) of said silicate, and wherein from about 1.0 to about 10.0 percent (by volume of said waste oil) of said aqueous solution of said silicate is added to said waste oil.

The use of silicates in the process of this invention provides at least two advantages. It eliminates the need for water addition to the oil, thus reducing the risk of hydrolyzing the oil contaminants, and also reducing the possibility of addition error. Furthermore, the use of the silicates increases the corrosion protection of the bottom sections, allowing these sections to be used as co-emulsifiers in soluble oil.

DETAILED DESCRIPTION OF SOME PREFERRED EMBODIMENTS

Any used oil which contains solid and/or liquid contaminants may be purified by the process of this invention. Thus, e.g., one may purify wash oil used in the benzol recovery system of a gas or by-product coke-oven plant; this waste oil is described in Jones U.S. Pat. No. 1,949,746 which is hereby incorporated by reference. Thus, e.g., one may purify cutting oils used in a gear cutting operation and in the machining of metal parts by this process; these cutting oils comprise a mixture of oils with a surface active agent which is mixed with water in order to form an emulsion. Thus, e.g., one may purify oil solutions containing dilute sulfuric acid which are used in steel pickling by this process. Lubricating oils which are employed to keep machinery and equipment running with a film of oil between mating metal parts may also be treated by this process. Oils which have been contaminated when used in brake shoe grinders and which contain asbestos dust particles may be purified by this process. Swaging oils also may be treated by this process. Hydraulic oils, which are used to operate machinery by rams and pistons and are usually under pressure, are effectively treated by this process; the contaminants of hydraulic oils include metal particles, rubber or asbestos seal particles, water, dirt, acid, and the like. Floor sweepings, oil absorbents, and dirt may also be cleaned by this process. Tramp oils may be treated by this process. Used detergent oil from internal combustion engines may be effectively purified by this process of this invention.

The aforementioned listing of substrates which may be used in the process of this invention is merely illustrative. The process of this invention is applcable to any waste oil which contains liquid and/or solid contaminants.

The process of this invention works especially well with hydraulic oil. In one preferred embodiment, the oil treated with the process of this invention is typical industrial machining oil which has been treated by standard industry methods (such as, e.g., sulfuric acid) to split the dirt and water out of it; this stock contains about 97 percent of oil and is acidic in nature.

The silicates used in the process of this invention are selected from group consisting of $$M_4SiO_4,\ M_{2n}(SiO_3)_n,\ \text{and}\ M_2SiO_5,$$

wherein n is an integer of from about 1 to 2, and M is an alkali metal. it is preferred that n be 1. M is selected from the group consisting of lithium, sodium and potassium. In a more preferred embodiment, M is selected from the group consisting of sodium and potassium. In the most preferred embodiment, M is sodium.

In one preferred embodiment, the silicate used is a metasilicate of the formula $M_2SiO_3$.

The silicates used in the process of this invention are well known to those in the art. They may be prepared, e.g., by the procedure described in pages 357–364 of book by Cotton and Wilinison entitled "Advanced Inorganic Chemistry" (Interscience, New York, 1962).

In the process of this invention from about 0.001 to about 0.8 pounds of the silicate are mixed with each gallon of waste oil. It is preferred to use from about 0.01 to about 0.4 pounds of the silicate per gallon of waste oil. It is more preferred to use from about 0.03 to about 0.1 pounds of the silicate per gallon of waste oil. In the most preferred embodiment, from about 0.04 to about 0.08 pounds of silicate are mixed with each gallon of waste oil.

It is preferred that the silicate be in an aqueous solution when it is added to the waste oil. The aqueous solution of the alkali metal silicate contains from about 1.0 to about 10.0 percent (by weight of said solution) of the silicate. It is preferred that the alkali metal silicate solution contain from about 2.0 to about 8.0 percent (by weight) of the silicate. In the most preferred embodiment, said solution contains about 3.0 percent (by weight) of said silicate.

It is preferred that from about 1.0 to about 10.0 percent (by volume of said waste oil) of said aqueous solution of said silicate be added to the waste oil. In a preferred embodiment, from about 2.0 to about 8.0 percent (by volume of waste oil) of said aqueous solution is added to the waste oil. In the most preferred embodiment, about 3.0 percent (by volume) of said aqueous solution is added to the waste oil.

It is preferred to add the aqueous solution of said silicate to a tank of waste oil, and to allow the solution to settle to the bottom of said tank. Thereafter, in this embodiment, the settled aqueous silicate solution is drawn from the bottom of the tank and pumped over the top of the tank, and the solution is mixed with the waste oil until a lump structure appears in the oil and the clarity of the oil is observed.

The aqueous solution of the alkali metal silicate may be mixed with the waste oil by any of the means well-known to the art. It may, e.g., be stirred. An excessive amount of stirring is not required; a slow stirring procedure is adequate because it is only necessary to mix the silicate material with the oil. Any type of stirring may be used such as mechanical stirrers, stem lances, air agitation, or even stirring by hand.

The aqueous solution of the alkali metal silicate may be mixed with the waste oil by, e.g., agitation. Agitation may be provided, e.g., by mixing the silicate with waste oil in a large metal vessel with a "Lightning" mixer or other similar mixing device, or it can be mixed in a gear pump or homogenizer.

The mixing of the alkali metal silicate solution and the waste oil is generally carried out until a lump structure appears in the oil, indicating that the waste oil has been thoroughly contacted with the silicate solution. Generally, such a lump structure occurs almost immediately after the waste oil is mixed with the solution of the alkali metal silicate, i.e., within the first 30 minutes after the solution is intimately contacted with the oil. When the lumps in the oil are relatively large, being from about 0.25" to about 0.75" in diameter, effective mixing of the alkali metal silicate solution and the waste oil has been accomplished. It is preferred that the lumps obtained in the oil be approximately 0.5" in diameter.

The mixture of the alkali metal silicate solution and the waste oil should be maintained at a temperature of from about 140 to about 200 degrees Fahrenheit. This is critical: unless the mixture is maintained at this temperature, one will not obtain the desired lump structure in the waste oil.

In the prior art oil purification processes, an emulsion was formed which was broken during a subsequent step of centrifugation. Such centrifugation step required the expenditures of substantial amounts of time and limited the quantities of oil which could be processed. In the present invention, centrifugation is not required: a satisfactory separation will occur if the oil-silicate solution mixture is allowed to settle. Ambient conditions may be used when the oil-silicate solution mixture is allowed to settle; alternatively, one may maintain the temperature of the mixture at from about 140 to 200 degrees Fahrenheit during the settling step.

After the oil-silicate solution mixture has settled, two phases will have formed: an alkaline bottoms phase, and a clear oil phase. The former may be reclaimed and used as coemulsifiers, and the latter may be further purified or, for certain applications, used as is.

The oil-silicate solution mixture is allowed to settle until the aforementioned two phases have been adequately formed and separated. In one embodiment of this invention, such settling occurs in from about 6 to about 30 hours. It is preferred to allow the mixture to settle for from about 8 to 16 hours. In the most preferred embodiment, it is preferred to allow the mixture to settle for about 10 to about 14 hours.

It is preferred that, when the oil-silicate solution mixture is being allowed to settle, the temperature of said mixture be maintained at a temperature of from about 140 to about 200 degrees Fahrenheit.

The clear oil which forms from the waste oil-silicate solution mixture may be decanted. Thereafter, it may be used as is; or it may be further purified.

In one preferred embodiment, the decanted clear oil is further purified by being heated, treated with concentrated sulfuric acid, allowed to settle, and decanted.

In this preferred embodiment, the decanted clear oil is heated to a temperature of from about 120 to about 200 degrees Fahrenheit. Then, while the clear oil is maintained at a temperature of from about 120 to about 200 degrees Fahrenheit for from about 1 to about 4 hours, concentrated sulfuric acid is added to the heated oil. It is preferred to add from about 1 to about 10 percent (by volume of clear oil) of the concentrated sulfuric acid; it is more preferred to add from about 2 to about 4 percent (by volume of clear oil) of concentrated sulfuric acid. Thereafter, the acid-treated clear oil is allowed to settle for a period of from about 6 to about 30 hours until an acid sludge phase an acid-treated clear oil phase have adequately formed and separated. It is preferred to allow this mixture to settle for from about 8 to about 16 hours; it is more preferred to allow this mixture to settle for from about 10 to about 14 hours.

Ambient temperatures are used in this preferred embodiment while the acid-clear oil mixture is settling. However, one may also heat the mixture to a temperature of from about 120 to about 200 degrees Fahrenheit during part or all of the settling step.

The acid sludge produced in this preferred step may be used to treat incoming waste oil prior to the time that said waste oil is subjected to the alkali metal silicate process of this invention.

The acid-treated clear oil phase may be decanted. This clear oil may be used as is; or it may be further treated to neutralize acid residues in it.

In one preferred embodiment, the acid-treated clear oil is neutralized by reacting it with an organic amine. Sufficient amine should be employed to impart to the oil a pH of from about 6 to about 8; neutralization of the oil is generally complete when the oil changes its color from dark blue to bright yellow and there is no presence of acid odor. Suitable amines for this purpose include, e.g., organic amines that result in oil-soluble sulfonates; alkyl amines, such as ethyl amine, diethyl amine, triethyl amine, and the like; alkanol amines, such as those which are disclosed in U.S. Pat. Nos. 1,780,144 and 2,204,326, the disclosures of which are hereby incorporated by reference; alkylene polyamines such as, e.g,. those described in U.S. Pat. No. 3,005,847, the disclosure of which is hereby incorporated by reference; higher molecular weight fatty acid amines which are capable of forming stable invert emulsions such as, e.g., cocoa amine, soyamine, safflower amine, and tall oil fatty acid amine; and the like.

The preferred organic amine is an alkanolamine of the formula

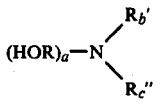

wherein R is a divalent organic radical containing from about 2 to about 5 carbon atoms, a is an integer of from about 1 to about 3, R' and R" are independently selected from the group consisting of alkyl radicals containing from about 1 to about 5 carbon atoms, b and c are integers independently selected from the group consisting of 0 and 1, and a plus b plus c equal 3. The most preferred alkanolamine is methyl diethanolamine.

It is preferred to neutralize the acid-treated clear oil with from about 0.05 to about 5.0 (by volume of the acid-treated clear oil) of the organic amine. It is more preferred to use from about 0.2 to about 2.0 percent (by volume of the acid-treated clear oil) of the organic amine. In the most preferred embodiment, from about 0.5 to about 1.0 percent (by volume of the acid-treated clear oil) of the organic amine is added to the acid-treated clear oil.

During the neutralization step, the acid-treated clear oil which is being neutralized may be at ambient temperature; however, higher or lower temperatures also may be used. After the acid-treated oil has been neutralized, it may be decanted as a finished oil. The bottom material in this neutralization step, sulfonated residue, may be incorporated into an emulsifier package.

The organic amine and the acid-treated clear oil should be mixed together and agitated until the pH of the mixture is from about 6 to about 8. Generally, this occurs in from about 15 to about 120 minutes. In a preferred embodiment, the organic amine and the acid-treated clear oil are mixed together and agitated for from about 30 to about 60 minutes.

When the desired pH of the amine-acid oil mixture is reached, the color of the mixture will change. In the case of hydraulic oil, the color of the oil changes from dark blue to bright yellow..

After the desired pH has been reached in the neutralization step, the neutralized oil is allowed to settle. Ambient temperatures may be used in this settling step. The neutralized oil is allowed to settle for from about 6 to about 30 hours. It is preferred to allow the oil to settle for from about 8 to about 16 hours; it is most preferred to allow the oil to settle for from about 10 to about 14 hours.

The top portion of the settled oil is a finished product. The bottom portion of the settled oil may be blended with a soluble base as a coemulsifier.

The alkaline bottoms phase from the alkali metal silicate treatment step may be further treated to reclaim it. Thus, e.g., glycol may be added to it while it is maintained at a temperature of from about 140 to about 200 degrees Fahrenheit until a grain structure is noted in the alkaline bottoms phase; then it may be treated with sodium bisulfate, causing a large lump structure to appear in the oil; this lump structure precipitates out.

In this alkaline bottoms treatment step, the alkaline bottoms phase is treated with a compound of the formula $$(HOR^4)_d—O—(R^5OH)_e,$$

wherein d and e are integers of from about 0 to about 2, d plus e equals 2, and $R^4$ and $R^5$ are independently selected from the group consisting of alkylene radicals containing from about 1 to about 4 carbon atoms.

The preferred glycol is diethylene glycol. However, other polyhydric compounds which contain from about 2 to about 10 carbon atoms and are well-known to those in the art may also be used.

During the alkaline bottoms reclamation step, the temperature of the alkaline bottoms fraction is maintained at from about 140 to about 200 degrees Fahrenheit.

The use of the glycol extracts the soaps from the alkaline bottoms. From about 5 to about 20 percent (by volume of the alkaline bottoms) of the glycol is added to the alkaline bottoms phase. It is preferred to add about 10 percent (by volume of the alkaline bottoms phase) of the glycol.

The temperature of the alkaline bottoms phase must be maintained at from about 140 to about 200 degrees Fahrenheit.

After the alkaline bottoms have been contacted with and treated with the glycol, a grain structure will appear in the oil, indicating that the reaction has taken place. It is preferred that, immediately after the grain structure appears, an aqueous solution of sodium bisulfate be added to the glycol-bottoms mixture.

The aqueous solution of sodium bisulfate which is used in the reclamation step contains from about 1 to about 10 percent (by weight of aqueous solution) of sodium bisulfate. It is preferred that said solution contain from about 2 to about 8 percent (by weight of aqueous solution) of sodium bisulfate; it is more preferred that said solution contain about 3 percent (by weight) of sodium bisulfate. In one preferred embodiment, 2 pounds of sodium bisulfate are mixed with 1 gallon of water to form an aqueous solution with a specific gravity at 60 degrees Fahrenheit of 1.200.

From about 5 to about 20 percent (by volume of the glycol-oil mixture) of the solution of sodium bisulfate is added to the glycol-oil mixture. It is preferred, however, to add about 10 percent (by volume) of the sodium bisulfate aqueous solution to the mixture.

The completion of the sodium bisulfate neutralization is indicated by the presence of large lump structures in the oil which rapidly settle out. When these lumps are from about 0.25" to about 0.75" in diameter, the neutralization has been completed. It is preferred that these large lumps be about 0.50" in diameter.

In place of the sodium bisulfate, one may use a suitable acid. Inorganic acids are preferred.

The bisulfate-glycol-oil mixture is allowed to settle for from about 6 to about 30 hours until at least about two phases form and separate. The top section will contain emulsifiers, coupling agents, and oil; the bottom section contains contaminants and may be washed with water to the water system.

In one preferred embodiment, the top section is used as a coemulsifier. In this embodiment, about twenty percent (by volume) of said top section is blended with about 5 percent (by volume) of an emulsifier package containing petroleum soap, tall oil fatty acid, resin soap, diethylene glycol, and caustic potash. This mixture, when balanced, forms a stable emulsion.

The bottom section from the sulfuric acid treatment step, which contains sulfonated residue, can be blended with a suitable soluble base as a coemulsifier. By way of illustration and not limitation, said bottom portion containing the sulfonated residue can be blended with a petroleum soap base.

The following example is presented to illustrate the claimed invention and is not to be deemed limitative thereof. Unless otherwise stated, all parts are by weight, all percentages are by weight, and all temperatures are in degrees centigrade.

EXAMPLE

The oil used in this example was used industrial machining oil which had been treated with sulfuric acid to split dirt and water out. It was acidic in nature; it contained an extreme pressure additive which was comprised of a fatty compount; and it was comprised of about 97 percent of oil.

The oil to be treated was charged to a container. Two parts of anhydrous sodium metasilicate were dissolved in one part of water; an exothermic reaction resulted.

The aqueous solution of sodium metasilicate was pumped into the oil tank, and it was allowed to settle to the bottom of the tank; about 3 percent (by volume of the oil to be treated) of the aqueous solution of sodium metasilicate was added to the oil. The temperature of the waste oil was maintained at from about 140 to about 200 degrees Fahrenheit during the addition of the solution of the sodium metasilicate and thereafter.

The aqueous solution of the sodium metasilicate, which had settled to the bottom of the tank, was drawn from the bottom of the tank and pumped over the top of the tank; and the solution was gently mixed with the waste oil until a lump structure in the waste oil was observed. Once the lump structure appeared, mixing was ceased.

The sodium metasilicate-waste oil mixture was allowed to settle for about 12 hours while it was maintained at a temperature of from about 140 to about 200 degrees Fahrenheit. Thereafter, the clear oil was decanted, leaving alkaline bottoms in the tank.

The alkaline bottoms were pumped to an alkaline treat tank. The alkaline bottoms were heated to a temperature of 140 to 200 degrees Fahrenheit. Ten percent (by volume of alkaline bottoms) of diethylene glycol was added to and mixed with the alkaline bottoms.

Two parts of sodium bisulfate were mixed with 64 parts of water. The resulting solution had a specific gravity at 60 degrees Fahrenheit of 1.2000.

As soon as grain structures were noted in the glycol-alkaline bottoms mixture, 10 percent (by volume of glycol-alkaline bottoms mixture) of the sodium bisulfate solution were added to the glycol-alkali bottoms mixture. Large lumps formed in the bisulfate-glycol-alkaline bottoms mixture, indicating that the neutralization was complete.

The bisulfate-glycol-alkaline bottoms mixture was allowed to settle. The bottom section was discharged with water to the water system. Twenty percent (by volume) of the top section was mixed with 5 percent (by volume) of a base comprising 52.7 percent of petroleum soap, 26.4 percent of tall oil fatty acid, 8.8 percent of resin soap, 8.8 percent of diethylene glycol, and 3.3 percent of caustic potash. This composition was balanced to form a stable emulsion.

The top section from the sodium metasilicate treatment tank was transferred to a sulfuric acid treatment tank. This top section, which contained alkaline clear oil, was heated to a temperature of from about 120 to about 200 degrees Fahrenheit and agitated while from about 2 to about 4 percent (by volume of alkaline clear oil) of concentrated sulfuric acid was slowly added to it. The alkaline oil was heated to the aforementioned temperature and the sulfuric acid was added to it over a period of from about 1 to about 4 hours.

The acid-alkaline clear oil mixture was allowed to settle for about 12 hours under ambient temperature conditions. Thereafter, the acid-treated clear oil was decanted and transferred to the neutralization tank.

From about 0.5 to about 1.0 percent of methyl diethanolamine were added to the acid-stripped oil. The color of the oil changed from dark blue to bright yellow, indicating that the neutralization was complete. The neutralized oil was allowed to settle overnight. The top section was then transferred to a storage tank. It could be blended with any of the proper additives (such as, e.g., the Zinc, Phosphorus, or Antiwear additive packages which are commercially available) and would be ready to be used as hydraulic oil. The bottom section was blended with a petroleum soap base.

Although this invention has been described in considerable detail in this specification, it is to be understood that such detail is solely for the purpose of illustration and that many variations may be made by those skilled in the art without departing from the spirit and scope of this invention.

The embodiments of this invention in which an exclusive property or privilege is claimed are as follows:

1. A process for purifying waste oil, comprising the steps of:

admixing with the waste oil an aqueous solution of an alkali metal silicate;

maintaining the waste oil-silicate solution mixture at a temperature of from about 140 to about 200 degrees Fahrenheit;

wherein from about 0.001 to about 0.8 pounds of a silicate selected from the group consisting of $$M_4SiO_4,\ M_{2n}(SiO_3)_n,\ \text{and}\ M_2SiO_5$$

where n is an integer of from about 1 to about 2, and M is an alkali metal, are mixed with each gallon of said waste oil;

wherein said aqueous solution of the alkali metal silicate contains from about 1.0 to about 10.0 percent, by weight of said solution, of said silicate;

wherein from about 1.0 to about 10.0 percent, by volume of said waste oil, of said aqueous solution of said silicate is added to said waste oil;

said waste oil and said solution of said alkali metal silicate are admixed until a lump structure appears in the oil; and thereafter the admixture is allowed to settle for from about 6 to about 30 hours while being maintained at a temperature of from about 140 to about 200 degrees Fahrenheit, whereby an alkaline clear oil top fraction as well as an alkaline bottom fraction are produced.

2. The process of claim 1, wherein:

n is 1.

3. The process of claim 2, wherein:
M is selected from the group consisting of sodium, potassium, lithium, rubidium, cesium and rubidium.
4. The process of claim 3, wherein:
said silicate is $M_2SiO_3$.
5. The process of claim 4, wherein:
from about 0.01 to about 0.4 pounds of said silicate are added per each gallon of said waste oil.
6. The process of claim 5, wherein:
M is sodium.
7. The process of claim 6, wherein:
said aqueous solution of said silicate contains from about 2.0 to about 8.0 percent, by weight of said solution, of said silicate.
8. The process of claim 7, wherein
from about 2.0 to about 8.0 percent, by volume of waste oil, of said aqueous solution of said silicate is added to the waste oil.
9. The process of claim 8, wherein:
said admixture of the waste oil and the alkali metal silicate solution is allowed to settle for from about 8 to about 16 hours.
10. The process of claim 9, wherein:
from about 0.03 to about 0.1 pounds of said silicate are added per each gallon of waste oil.
11. The process of claim 10, wherein:
the admixture of the waste oil and the alkali metal silicate is allowed to settle for from about 10 to about 14 hours.
12. The process of claim 11, wherein:
said aqueous solution of said silicate contains about 3.0 percent, by weight, of said silicate.
13. The process of claim 12, wherein:
about 3.0 percent, by volume of waste oil, of said aqueous solution of said silicate is added to the waste oil.
14. The process of claim 13, wherein:
the admixture of the waste oil and the alkali metal silicate is allowed to settle for about 12 hours.
15. The process of claim 14, wherein:
from about 0.04 to about 0.08 pounds of said silicate are added per gallon of waste oil.
16. The process of claim 15, wherein:
said alkaline clear oil top fraction is heated to a temperature of from about 120 to about 200 degrees Fahrenheit for from about 1 to about 4 hours while from about 1 to about 10 percent, by volume of said alkaline clear oil top fraction, of concentrated sulfuric acid is slowly added to said alkaline clear oil top fraction; and
wherein the mixture of sulfuric acid and alkaline clear oil top fraction is allowed to settle for from about 6 to about 30 hours under ambient temperature conditions, whereby an acid-treated clear oil fraction is produced.
17. The process of claim 16, wherein:
from about 2 to about 4 percent, by volume of said alkaline clear oil top fraction, of concentrated sulfuric acid is slowly added to the alkaline clear oil top fraction; and
the mixture of the sulfuric acid and the alkaline clear oil top fraction is allowed to settle for from about 8 to about 16 hours.
18. The process of claim 17, wherein:
the mixture of the sulfuric acid and the alkaline clear oil top fraction is allowed to settle for about 12 hours.
19. The process of claim 18, wherein:
said acid-treated clear oil fraction is mixed with from about 0.05 to about 5.0 percent, by volume of the acid-treated clear oil, of an organic amine; and
the mixture of the amine and the clear oil fraction are mixed together and agitated for from about 15 to about 120 minutes until the pH of the mixture is from about 6 to about 8.
20. The process of claim 19, wherein:
said organic amine is methyl diethanoloamine; and
wherein said amine and the acid-treated clear oil are mixed together for from about 15 to about 30 minutes.
21. The process of claim 20, wherein:
from about 0.2 to about 2.0 percent, by volume of the acid-treated clear oil, of the organic amine is mixed with the acid-treated clear oil.
22. The process of claim 21, wherein:
from about 0.5 to about 1.0 percent of the organic amine is mixed with the acid-treated clear oil.
23. A process of re-refining waste oil, comprising the steps of:
dissolving sodium metasilicate anhydrous in water to a ratio of substantially two pounds of sodium metasilicate anhydrous to each gallon of water;
transferring the solution of sodium metasilicate anhydrous to a tank of said waste oil which oil is substantially 90 percent pure with dry solids therein;
permitting said solution of sodium metasilicate anhydrous to settle to the bottom of said tank;
gently agitating said waste oil and said sodium metasilicate solution until there appears a lump structure in the oil, and the clarity of the oil is observed;
maintaining the temperature of the oil to be at least 140 degrees Fahrenheit;
permitting the oil and solution of sodium metasilicate anhydrous to settle, whereby an alkaline clear oil top fraction as well as an alkaline bottom fraction are produced;
decanting the clear oil;
heating the clear oil to a temperature in the range of approximately 120 degrees Fahrenheit to 140 degrees Fahrenheit;
slowly adding sulfuric acid which is in the range of from 2 to 4 percent by volume to the oil while maintaining agitation for a predetermined period of time;
permitting the oil to settle without heat overnight;
decanting the clear oil and transferring the clear oil to a neutralizing tank;
adding methyl diethanolamine in a volume of approximately ½ to 1 percent, and agitating thoroughly for ½ hour to one hour, until the color of the oil changes from dark blue to a bright yellow and there is no presence of any of the acid color;
permitting the oil to then settle overnight; and
transferring the top portion of the settled oil to a storage tank ready to be used as hydraulic oil with its proper additives.
24. A process according to claim 23, wherein:
after said last transferring step, there is included the step of blending said alkaline bottom fraction of the settled oil, containing a sulfonated residue, with a soluble base as a coemulsifier.
25. A process according to claim 3 or 24, wherein:
said alkaline bottom fraction is treated with a compound selected from the group consisting of $(HOR^4)_d—O(R^5OH)_e$ where d and e are integers of from about 0 to about 2, and d plus e equals 2, and $R^4$ and $R^5$ are independently selected from the group consisting of alkylene radicals containing from about 1 to about 4 carbon atoms.

26. A process according to claim 25, including the steps of:

treating said alkaline bottom fraction with approximately 10 percent by volume of said compound to extract the soap from said alkaline bottom fraction;

neutralizing said alkaline bottom fraction with 10 percent of a solution of sodium bisulfate having a specific gravity of 1.200 at 60 degrees F while maintaining a temperature in a range of 120 degrees F. to 200 degrees F. to obtain a bottom section containing contaminants, and a top section containing emulsifiers, coupling agents, and oil; and washing away said contaminants.

27. A process according to claim 26, including the step of:

mixing said top section with a petroleum soap coemulsifier.

28. A process according to claim 27, wherein:

said top section is mixed with a coemulsifier which comprises a petroleum soap, a tall oil fatty acid, a resin soap, a diethylene glycol, and caustic potash.

29. A process according to claim 28, wherein:

approximately 13 to 15 percent by volume of said coemulsifier is added to said top section to produce a soluble oil.

30. A process according to claim 29, wherein:

approximately 20 percent by volume of said top section is mixed with approximately 5 percent of said coemulsifier, and then balanced to form a stable emulsion.

31. A product produced in accordance with a process for purifying waste oil, said process comprising the steps of:

admixing with the waste oil an aqueous solution of an alkali metal silicate;

maintaining the waste oil-silicate solution mixture at a temperature of from about 140 to about 200 degrees Fahrenheit;

wherein from about 0.001 to about 0.8 pounds of a silicate selected from the group consisting of $M_4SiO_4$, $M_{2n}(SiO_3)n$, and $M_2SiO_5$ where n is an integer of from about 1 to about 2, and M is an alkali metal, are mixed with each gallon of said waste oil;

wherein said aqueous solution of the alkali metal silicate contains from about 1.0 to about 10.0 percent, by weight of said solution, of said silicate; and wherein from about 1.0 to about 10.0 percent, by volume of said waste oil, of said aqueous solution of said silicate is added to said waste oil;

said waste oil and said solution of said alkali metal silicate are admixed until a lump structure appears in the oil; and thereafter the admixture is allowed to settle for from about 6 to about 30 hours while being maintained at a temperature of from about 140 to about 200 degrees Fahrenheit, whereby an alkaline clear oil top fraction as well as an alkaline bottom fraction are produced.

32. The product of claim 31, wherein:

n is 1.

33. The product of claim 32, wherein:

M is selected from the group consisting of sodium, potassium, lithium, rubidium, cesium and rubidium.

34. The product of claim 33, wherein:

said silicate is $M_2SiO_3$.

35. The product of claim 34, wherein:

from about 0.01 to about 0.4 pounds of said silicate are added per each gallon of said waste oil.

36. The product of claim 35, wherein:

M is sodium.

37. The product of claim 36, wherein:

said aqueous solution of said silicate contains from about 2.0 to about 8.0 percent, by weight of said solution, of said silicate.

38. The product of claim 37, wherein:

from about 2.0 to about 8.0 percent, by volume of waste oil, of said aqueous solution of said silicate is added to the waste oil.

39. The product of claim 38, wherein:

said admixture of the waste oil and the alkali metal silicate solution is allowed to settle for from about 8 to about 16 hours.

40. The product of claim 39, wherein:

from about 0.03 to about 0.1 pounds of said silicate are added per each gallon of waste oil.

41. The product of claim 40, wherein:

the admixture of the waste oil and the alkali metal silicate is allowed to settle for from about 10 to about 14 hours.

42. The product of claim 41, wherein:

said aqueous solution of said silicate contains about 3.0 percent, by weight, of said silicate.

43. The product of claim 42, wherein:

about 3.0 percent, by volume of waste oil, of said aqueous solution of said silicate is added to the waste oil.

44. The product of claim 43, wherein:

the admixture of the waste oil and the alkali metal silicate is allowed to settle for about 12 hours.

45. The product of claim 44, wherein:

from about 0.04 to about 0.08 pounds of said silicate are added per gallon of waste oil.

46. The product of claim 45, wherein:

said alkaline clear oil top fraction is heated to a temperature of from about 120 to about 200 degrees Fahrenheit for from about 1 to about 4 hours while from about 1 to about 10 percent, by volume of said alkaline clear oil top fraction, of concentrated sulfuric acid is slowly added to said alkaline clear oil top fraction; and wherein the mixture of sulfuric acid and alkaline clear oil top fraction is allowed to settle for from about 6 to about 30 hours under ambient temperature conditions, whereby an acid-treated clear oil fraction is produced.

47. The product of claim 46, wherein:

from about 2 to about 4 percent, by volume of said alkaline clear oil top fraction, of concentrated sulfuric acid is slowly added to the alkaline clear oil top fraction; and the mixture of the sulfuric acid and the alkaline clear oil top fraction is allowed to settle for from about 8 to about 16 hours.

48. The product of claim 47, wherein:

the mixture of the sulfuric acid and the alkaline clear oil top fraction is allowed to settle for about 12 hours.

49. The product of claim 48, wherein:

said acid-treated clear oil fraction is mixed with from about 0.05 to about 5.0 percent, by volume of the acid-treated clear oil, of an organic amine; and the mixture of the amine and the clear oil fraction are mixed together and agitated for from about 15 to about 120 minutes until the pH of the mixture is from about 6 to about 8.

50. The product of claim 49, wherein:

said organic amine is methyl diethanolamine; and wherein said amine and the acid-treated clear oil are mixed together for from about 15 to about 30 minutes.

51. The product of claim 50, wherein:

from about 0.2 to about 2.0 percent, by volume of the acid-treated clear oil, of the organic amine is mixed with the acid-treated clear oil.

52. The product of claim 51, wherein:

from about 0.5 to about 1.0 percent of the organic amine is mixed with the acid-treated clear oil.

53. A product produced in accordance with a process of re-refining waste oil, said process comprising the steps of:

dissolving sodium metasilicate anhydrous in water to a ratio of substantially two pounds of sodium metasilicate anhydrous to each gallon of water;

transferring the solution of sodium metasilicate anhydrous to a tank of said waste oil which oil is substantially 90 percent pure with dry solids therein;

permitting said solution of sodium metasilicate anhydrous to settle to the bottom of said tank;

gently agitating said waste oil and said sodium metasilicate solution until there appears a lump structure in the oil, and the clarity of the oil is observed;

maintaining the temperature of the oil to be at least 140 degrees Fahrenheit;

permitting the oil and solution of sodium metasilicate anhydrous to settle, whereby an alkaline clear top fraction as well as an alkaline bottom fraction are produced;

decanting the clear oil;

heating the clear oil to a temperature in the range of approximately 120 degrees Fahrenheit to 140 degrees Fahrenheit;

slowly adding sulfuric acid which is in the range of from 2 to 4 percent by volume to the oil while maintaining agitation for a predetermined period of time;

permitting the oil to settle without heat overnight;

decanting the clear oil and transferring the clear oil to a neutralizing tank;

adding methyl diethanolamine in a volume of approximately ½ to 1 percent, and agitating thoroughly for ½ hour to one hour, until the color of the oil changes from dark blue to a bright yellow and there is no presence of any of the acid color;

permitting the oil to then settle overnight; and transferring the top portion of the settled oil to a storage tank ready to be used as hydraulic oil with its proper additives.

54. A product according to claim 53, wherein:

after said last transferring step, there is included the step of blending said alkaline bottom fraction of the settled oil, containing a sulfonated residue, with a soluble base as a co-emulsifier.

55. A product according to claim 31, wherein:

said alkaline bottom fraction is treated with a compound selected from the group consisting of $$(HOR^4)_d-O-(R^5OH)_e$$

where d and e are integers of from about 0 to about 2, and d plus e equals 2, and $R^4$ and $R^5$ are independently selected from the group consisting of alkylene radicals containing from about 1 to about 4 carbon atoms.

56. A product according to claim 54, wherein:

said alkaline bottom fraction is treated with a compound selected from the group consisting of $$(HOR^4)_d-O-(R^5OH)_e$$

where d and e are integers of from about 0 to about 2, and d plus e equals 2, and $R^4$ and $R^5$ are independently selected from the group consisting of alkylene radicals containing from about 1 to about 4 carbon atoms.

57. A product according to claim 56, including the steps of:

treating said alkaline bottom fraction with approximately 10 percent by volume of said compound to extract the soap from said alkaline bottom fraction;

neutralizing said alkaline bottom fraction with 10 percent of a solution of sodium bisulfate having a specific gravity of 1.200 at 60 degrees F. while maintaining a temperature in a range of 120 degrees F. to 200 degrees F. to obtain a bottom section containing contaminants, and a top section containing emulsifiers, coupling agents, and oil; and washing away said contaminants.

58. A product according to claim 57, including the step of:

mixing said top section with a petroleum soap coemulsifier.

59. A product according to claim 58, wherein:

said top section is mixed with a coemulsifier which comprises a petroleum soap, a tall oil fatty acid, a resin soap, a diethylene glycol, and caustic potash.

60. A product according to claim 59, wherein:

approximately 13 to 15 percent by volume of said coemulsifier is added to said top section to produce a soluble oil.

61. A product according to claim 60, wherein:

approximately 20 percent by volume of said top section is mixed with approximately 5 percent of said coemulsifier, and then balanced to form a stable emulsion.

* * * * *